United States Patent [19]

Johenning et al.

[11] Patent Number: 4,583,254

[45] Date of Patent: Apr. 22, 1986

[54] LOW TENSION WATERBED MATTRESS WITH AESTHETIC APPEARANCE

[76] Inventors: John B. Johenning, 9724 Cataragus, Los Angeles, Calif. 90034; Charles P. Hall, 5815 Bennett Valley Rd., Santa Rosa, Calif. 95404

[21] Appl. No.: 591,013

[22] Filed: Mar. 19, 1984

[51] Int. Cl.[4] ..... A47C 27/08

[52] U.S. Cl. ..... 5/451; 5/450

[58] Field of Search ..... 5/451, 452, 450, 449, 5/455, 422, 441; 264/553

[56] References Cited

U.S. PATENT DOCUMENTS

| | | | |
|---|---|---|---|
| 3,497,059 | 2/1970 | Watts | 264/553 |
| 3,689,949 | 9/1972 | Weinstein et al. | 5/348 |
| 3,707,735 | 1/1973 | Carson | 5/451 |
| 3,810,265 | 5/1974 | McGrew | 5/451 |
| 3,842,455 | 10/1974 | Whitney | 5/451 |
| 3,849,814 | 11/1974 | Ross | 5/451 |
| 4,107,799 | 8/1978 | Lambert | 5/451 |
| 4,192,031 | 3/1980 | Fogel | 5/451 |
| 4,301,560 | 11/1981 | Fraige | 5/450 |
| 4,345,348 | 8/1982 | Hall | 5/450 |
| 4,422,194 | 12/1983 | Viesturs et al. | 5/455 |

FOREIGN PATENT DOCUMENTS

| | | | |
|---|---|---|---|
| 550650 | 5/1932 | Fed. Rep. of Germany | 5/451 |

*Primary Examiner*—Alexander Grosz

*Attorney, Agent, or Firm*—Sheldon & Mak

[57] ABSTRACT

A low tension waterbed mattress has a top with a plurality of expandable folds molded therein so that the top wall stretches when a user lays on the mattress so that the user is not laying on a taut sleeping surface. The folds have an aesthetic appearance. The mattress is typically filled to a volume providing a depth at least 3 inches less than the capacity of the mattress. The top wall of the mattress has a surface area at least 3% larger than the surface area of the bottom wall of the mattress.

18 Claims, 7 Drawing Figures

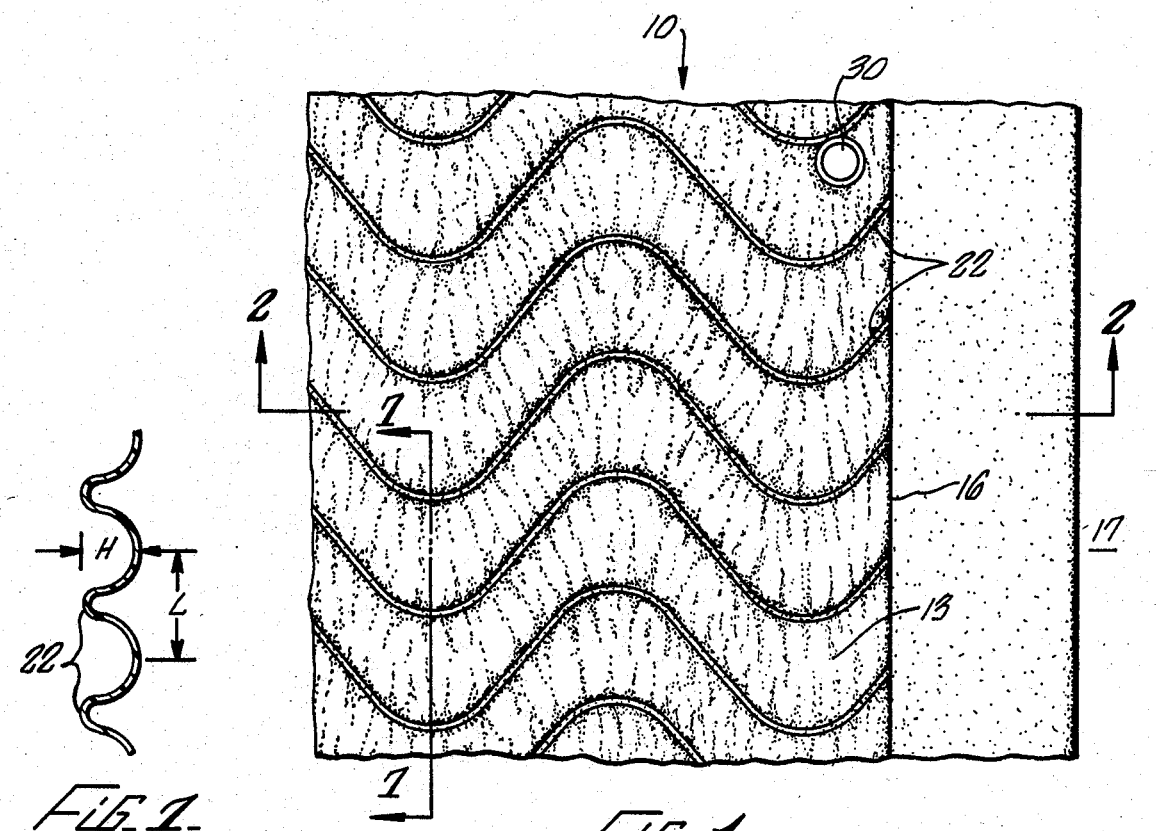
FIG. 3.
FIG. 1.
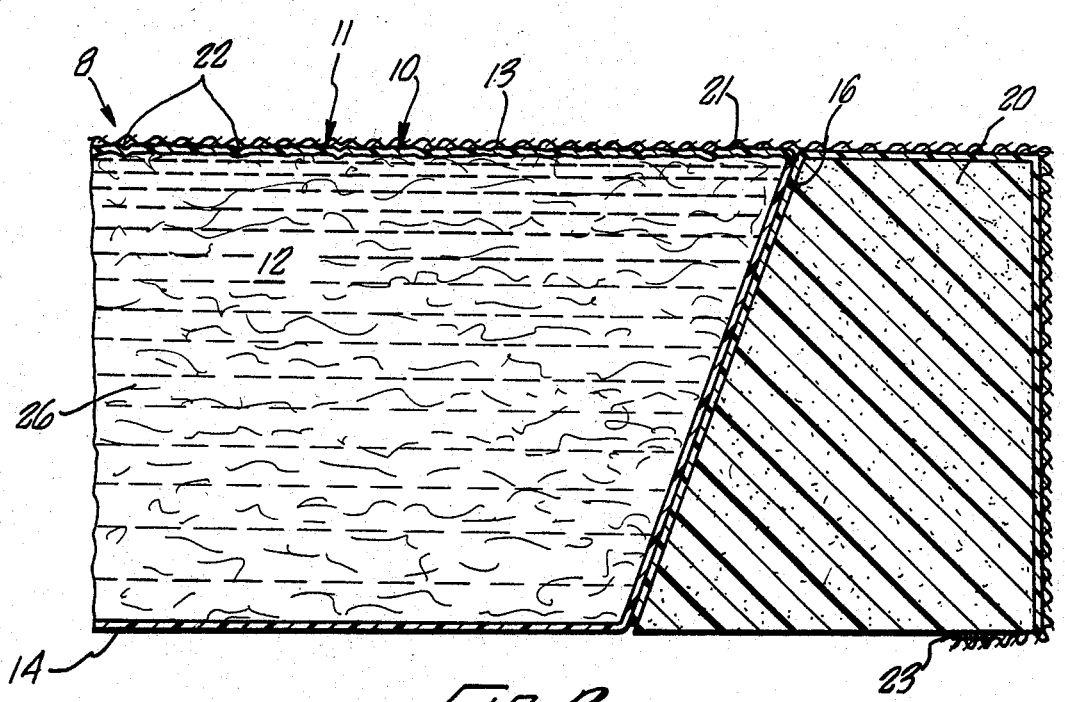
FIG. 2.

LOW TENSION WATERBED MATTRESS WITH AESTHETIC APPEARANCE

BACKGROUND

The present invention relates to waterbed mattresses.

A problem with conventional waterbed mattresses is that the user does not really sleep on water. Rather, the user sleeps on polymeric material. Waterbed mattresses typically are made of an envelope having a top wall, a bottom wall, and side walls formed of a polymeric material such as polyvinylchloride. Other polymeric materials that have been suggested include polyethylene.

Mattresses are generally filled with water to about their design capacity, the depth of the water being from 8 to 9 inches. The amount of water placed in the mattress controls the "firmness" of the mattress.

When a person lays on the mattress, the top wall becomes taut and has high tension. Although the user believes he is sleeping on water, the dominant effect is produced by the taut top wall of the mattress. Although such a waterbed is more comfortable for many persons than a conventional box spring and mattress, the user is really not "floating" on water. It is believed that the lack of comfort resulting from the taut top wall has prevented some persons from using a waterbed.

Another problem with available waterbed designs is that the mattress itself has limited aesthetic appeal in the showroom. It is usually no more than flat, stretched piece of vinyl material which may have wrinkles on its top surface. This is in sharp contrast to the aesthetically pleasing and textured surface provided by the fabric on conventional mattresses. Since waterbed mattresses and conventional mattresses are often sold side-by-side in retail outlets, this is a significant competitive disadvantage for waterbed mattresses.

SUMMARY

The present invention is directed to a waterbed mattress that overcomes these problems. The mattress has a polymeric top wall providing a sleeping surface, a bottom wall, and side walls. The top wall has a length and a width and a plurality of expandable folds molded therein so that the top wall stretches when a user lays on the mattress. The ratio of the surface area of the top wall when pulled taut to the surface area of the bottom wall when pulled taut is at least 1.03, and generally is less than 1.2. Preferably the folds are in a regular and uniform repeating pattern for aesthetic appeal.

To achieve the desired amount of stretching, preferably the folds are spaced apart from each other by a distance (L), of from about ¼ to about 4 inches, more preferably from about 1 to about 3 inches, and most preferably by about 2 inches. The ratio of the height of the folds (H) to (L) is preferably from about 1/16 to about 1, more preferably from about ⅛ to about ½, and most preferably is about ¼.

When the top and bottom walls are pulled taut, the sum of the length and width of the top wall is at least 5 inches greater, and generally no more than 20 inches greater, than the sum of the length and width of the bottom wall. Thus, when a user lays on the mattress, he feels as if he is truly floating in water, rather than laying on a taut sleeping surface.

The folds are oriented so that stretching of the mattress occurs more easily from side-to-side than from head-to-foot. Usually a person sleeps in the mattress aligned with the length. Preferably the folds are oriented so that when stretching occurs, the width stretches by a greater percentage than does the length.

This feeling of floating in water can best be effected by filling the mattress to less than its capacity. The mattress generally has a capacity of at least 12 inches of water. In the use of a mattress according to the present invention, the mattress contains water in an amount at least 3 inches less than its capacity. Thus, for a mattress with 12 inches of water capacity, the mattress contains no more than 8 to 9 inches of water. For a mattress with 14 inches of water capacity, the mattress contains no more than 11 inches of water.

Preferably the mattress contains a cushion for preventing bottoming of the top wall of the mattress when a user sits or lays on the mattress.

In an alternate version of the invention, folds can be provided in the side walls of the mattress to provide stretching when a user lays on the mattress. Preferably means are provided for biasing the top wall and bottom wall of the mattress together so that the stretching occurs only when the user lays on the mattress.

DRAWINGS

These and other features, aspects, and advantages of the present invention will become better understood with reference to the following description, appended claims, and accompanying drawings where:

FIG. 1 is a top plan view of a portion of a waterbed having a waterbed mattress according to the present invention, the mattress having regular repeating folds molded into its top surface;

FIG. 2 is a vertical sectional view of a portion of the bed of FIG. 1, without a cover taken on line 1—1 in FIG. 1;

FIG. 7 is another vertical sectional view of the mattress of FIG. 1 shown the details of the folds.

DESCRIPTION

Figure 3:
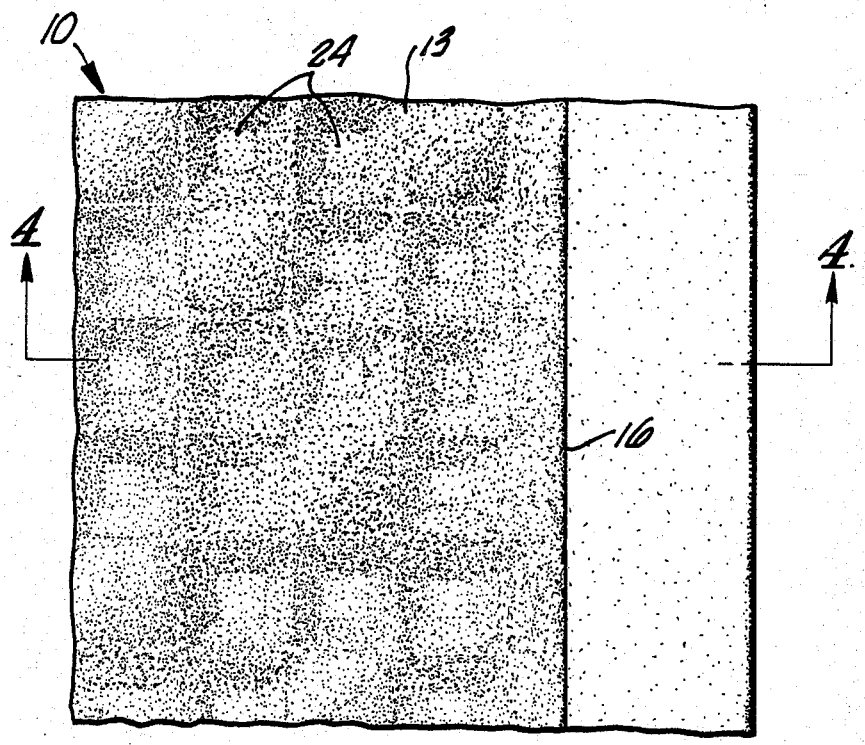
FIG. 3 shows another version of a waterbed having a mattress according to the present invention, the mattress having regular repeating folds molded into its top surface.

With reference to FIGS. 1 and 2, the present invention is directed to a waterbed 8 having a waterbed mattress 10 that includes an enclosing structure 11 containing a body of water 12. The enclosing structure is fabricated of a flexible polymeric material such as polyvinylchloride or polyethylene. The mattress 10 comprises a top wall 13, a bottom wall 14, and side walls 16. The top wall 13 is adapted for receiving persons in sitting and reclining positions and provides a sleeping surface of the mattress. Water can be introduced into or removed from the mattress through a valve 30 in the top wall 13 near the foot 17 of the bed.

The waterbed 8 can include a frame 20 that encloses the side walls 16 of the mattress 10. The frame 20 shown in the figures is formed of a foam material such as polyurethane foam. Other types of frames can be used such as wood frames, air frames, and plastic frames. Generally the height of the frame 20 is about equal to the height of the filled mattress 10. The mattress can also be provided with a liner underneath the mattress and between the foam frame 20 and the mattress. For simplicity, the liner is not shown in the figures.

The waterbed 8 can be provided with a cover 21 that extends over the mattress 10 and the frame 20. The cover 21 is tucked under the frame 20 and is held in place by hook and loop type fasteners 23 such as the ones sold under the trademark of Velcro.

The top wall 13 of the mattress has a plurality of folds 22 molded therein. By the term "folds" there is meant a part of the top wall that is doubled or laid over another part, including pleats, shirring, puckers, and gathers.

The folds are expandable so that the top wall stretches when a user lays on the mattress. Preferably sufficient expansion is provided that the ratio of the surface area of the top wall 13 when pulled taut to the surface area of the bottom wall 14 when pulled taut is at least 1.03, and preferably at least 1.05. By the term "pulled taut" there is meant that the top wall or bottom wall is subjected to a pulling force of 10 pounds. At a ratio of greater than 1.03, a person laying on the mattress feels as if he is actually floating in water, rather than being supported by the top wall of the mattress.

Preferably this ratio is less than about 1.5 because bottoming out can occur, i.e. the top wall can come into contact with the bottom wall. Also, at ratios greater than about 1.5, it is difficult to form folds that are aesthetically pleasing. Further, the user can end up sleeping on wrinkles, which can be uncomfortable. More preferably, the ratio is less than about 1.2, and most preferably between about 1.05 and 1.1.

When the top and bottom walls are pulled taut, the sum of the length and width of the top wall due to the expandable folds 22 is at least 5 inches greater than the sum of the length and width of the bottom wall. Generally the sum and length of the width of the top wall is no more than 20 inches, and preferably no more than 10 inches greater than the sum of the length and width of the bottom wall.

When calculating the sum of the length and width of a mattress, each dimension is added once. For example, the sum of the width and length of a mattress 96 inches by 84 inches is 180 inches.

The folds or pleats 22 are formed into a pattern that is expandable and aesthetically pleasing. A large number of patterns can be used. For example, as shown in FIG. 1, a curvilinear repeating pattern where each fold 22 has a wave-like configuration can be used.

With reference to FIG. 7, the folds of FIG. 1 are spaced apart from each other by a distance L and each fold has a height H, where H is the vertical distance from the top of one fold to the trough of an adjacent fold, i.e. twice the amplitude of each fold. To achieve the desired stretching, preferably L is from about $\frac{1}{4}$ inch to about 4 inches, more preferably from about 1 to about 3 inches, and most preferably about 2 inches, while the ratio of H to L is preferably from about 1/16 to about 1, more preferably from about $\frac{1}{8}$ to about $\frac{1}{2}$, and most preferably about $\frac{1}{4}$. In the version of FIG. 1, L is 2 inches and H is $\frac{1}{2}$ inch.

Preferably the cover 21 stretches an amount about the same as the mattress 10 stretches. Otherwise, benefits obtained from the stretchable mattress are not realized because the user of the mattress feels as if he is sleeping on a taut cover.

As shown in FIG. 1, preferentially the folds 22 are oriented so that stretching of mattress 10 preferentially occurs side-to-side rather than from head-to-foot. In use of a mattress, generally there is more need for side-to-side stretching, particularly where two people are sleeping on the mattress 10.

In the version of the invention shown in FIG. 3, the folds 24 are in the shape of circular bumps or raised portions. As shown in FIGS. 1 and 3, it is desirable that the folds 22 and 24 be in a regular, uniform repeating pattern so that the expansion of the top wall of the mattress occurs uniformly cross its surface and so that the appearance of the top wall is attractive.

A variety of other shapes can be used, including curled, looped, swirled, curlique, quilted, box, rectangular, and triangular patterns.

Preferably the mattress 10 is provided with an internal structure to avoid bottoming out of the mattress, particularly when the ratio of the surface area of the top wall to the bottom wall is large. A variety of structures conventionally used for baffling can be provided. For example, as shown in FIG. 2, the inside of the mattress can be provided with fiber material 26. The use of fiber in a mattress is described in U.S. Pat. No. 4,301,560 issued to Fraige.

Figure 4:
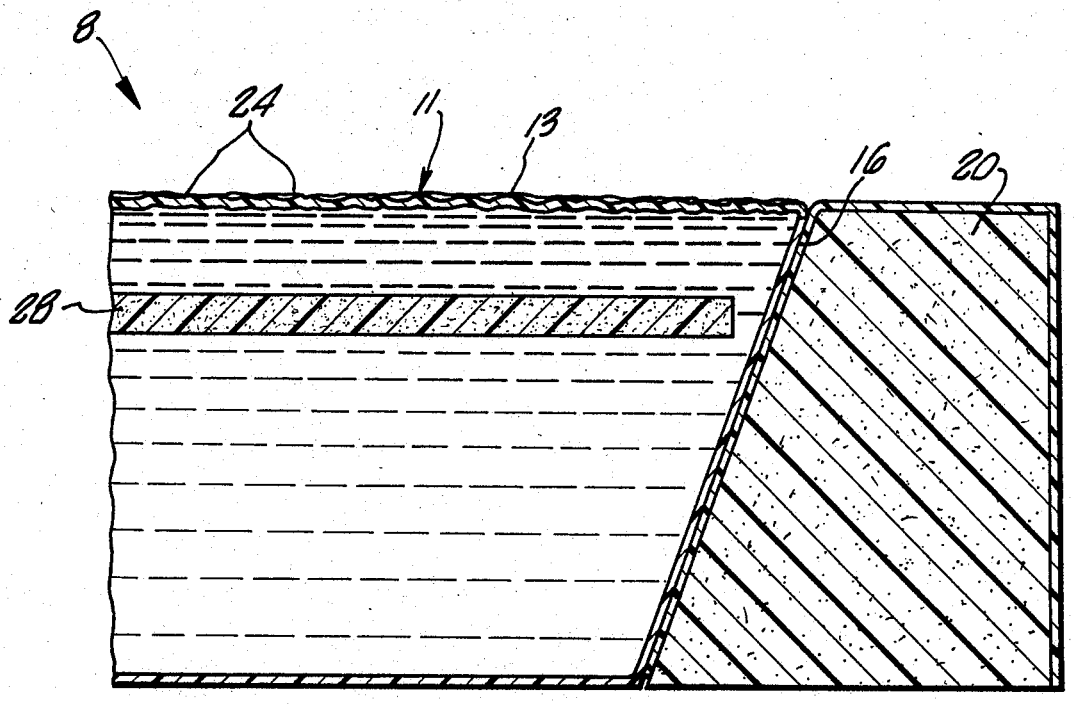
FIG. 4 is a vertical sectional view of a portion of the bed of FIG. 3 taken along line 4—4 in FIG. 3.

In FIG. 4 there is shown a baffle structure comprising a horizontal, floating piece of foam 28 as described in U.S. Pat. No. 4,345,348 issued to Charles P. Hall, which is incorporated herein by this reference.

Preferably the mattress 10 is not filled to capacity. By the term "capacity", there is meant the amount of water in the mattress when the center of the mattress becomes higher than that portion of the mattress 4 inches from the side, i.e. when a crowning effect first occurs. Normally waterbed mattresses have an 8 to 9 inch capacity. That is, when the mattress is filled to capacity, its height is about 8 inches. Likewise, the frames 20 provided for the mattress generally are about 8 to 9 inches in height.

A mattress according to the present invention has a capacity at least about 3 inches greater than the amount of water in the mattress. A mattress designed to fit into a conventional frame has a capacity of at least 11 to 12 inches and when used would contain about 8 to 9 inches of water to obtain a feeling of floating in water. Preferably the capacity of the mattress is about 6 inches greater than the amount of water in the mattress. For example, a mattress filled to thickness of about 8-$\frac{1}{2}$ to 9-$\frac{1}{2}$ inches has a capacity of 14 inches or greater. Preferably the capacity is no more than about 9 inches greater than the amount the mattress is to be filled to avoid bottoming out in use.

The enclosing structure 11 can be formed in any suitable manner. Preferably it is formed by bonding two planar sheets together along their peripheries or by bonding two upstanding sheets between the edges of the top and bottom walls to form a contour or fitted structure.

To obtain the folds in the top wall of the mattress, preferably the top wall is vacuum molded. In vacuum forming the top wall, the vinyl material is heated until it softens, generally to a temperature of about 250° F. Preferably high molecular weight vinyl is used to take the set required to form the folds. Preferably the top wall is formed from thicker vinyl than the remaining portion of the mattress to accommodate the folds. For example, the top wall can be formed from 25 mil thick (0.025 inch) vinyl while the bottom wall is formed from a sheet of 20 mil thick vinyl.

Figure 5:
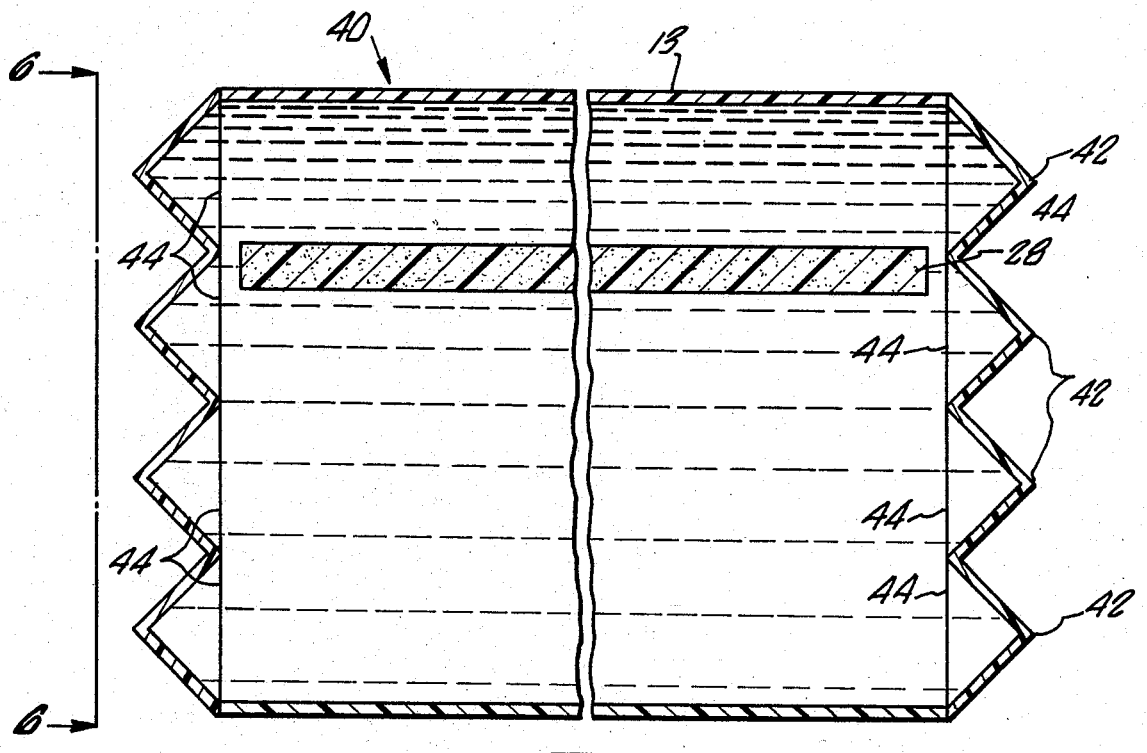
FIG. 5 is a vertical sectional view of another version of a mattress according to the present invention where folds are molded into the side wall of the mattress.
Figure 6:
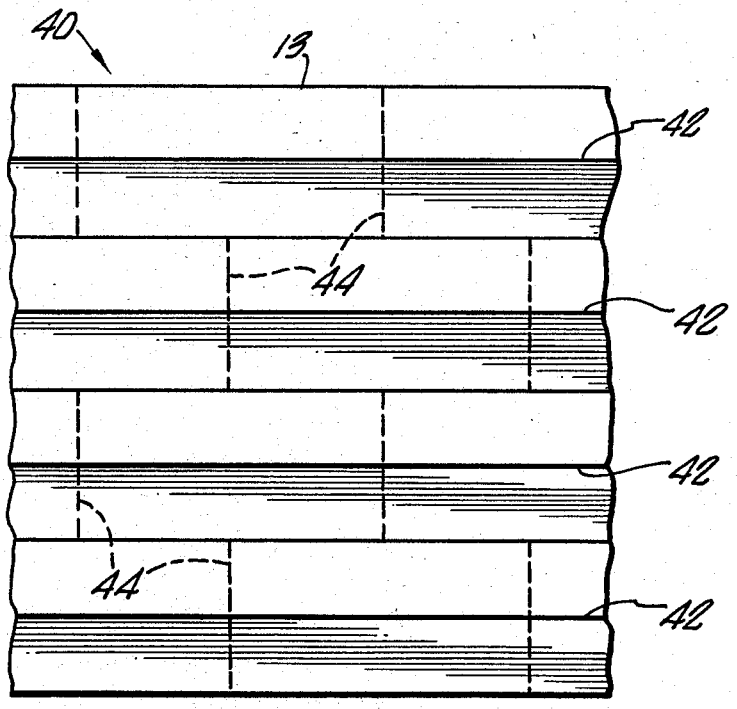
FIG. 6 is a side elevation view of the mattress of FIG. 5 taken on line 6—6 in FIG. 5.

In an alternate version of the present invention, rather than providing the folds in the top wall, the folds can be provided in the side walls, as shown in FIGS. 5 and 6. In the mattress 40 shown in FIGS. 5 and 6, there are a plurality of folds 42 in the side walls, giving an accordion-like appearance. To avoid sagging when a user is not on the mattress, internal elastic ties 44 are provided which pull the folds toward each other and pull the top and bottom walls toward each other. The ties 44 can be made of a polymeric synthetic rubber material that can be heat welded or bonded by adhesive to the mattress. A suitable material is Neoprene rubber. These elastic members 44 maintain the mattress in a generally box-like configuration when someone is not laying on the mattress, but allow the folds 42 to expand without excessive resistance when weight is placed on the top wall 13 of the mattress. If desired, external elastic ties can be used in place of or in addition to the internal ties 44.

The mattress of the present invention has significant advantages. Not only is it aesthetically pleasing, it provides a true feeling of "floating" in water. Further, excessive pressure on the person sleeping is avoided. Moreover, when two persons of different weights are sleeping on the mattress, due to the high compliance and stretchability of the pleated top surface, the lighter person is not pulled into a "valley" formed by the heavier person.

Although the present invention has been described in considerable detail with reference to certain preferred versions thereof, other versions are possible. For example, a mattress having folds in both the top wall and the side wall can be provided. Therefore, the spirit and scope of the appended claims should not necessarily be limited to the description of the preferred versions contained herein.

What is claimed is:

1. A waterbed mattress having a polymeric top wall providing a sleeping surface, a bottom wall, and side walls, the ratio of the surface area of the top wall when pulled taut to the surface area of the bottom wall when pulled taut being at least 1.05 and less than 1.2, the top wall having a plurality of expandable folds formed therein so that the top wall stretches when a user lays on the mattress, at least a portion of the folds being in a regular repeating pattern spaced apart from each other by a distance, L, of from about $\frac{1}{4}$ to about 3 inches, the ratio of the height of the regularly repeating folds to L being from about $\frac{1}{8}$ to about $\frac{1}{2}$, the mattress capacity being at least 11 inches of water, and the mattress containing (i) water in an amount of at least 3 inches less than its capacity and (ii) a baffle for reducing wave motion in the mattress and for preventing bottoming of the top wall of the mattress when a user sits or lays on the mattress.

2. The waterbed mattress of claim 1 wherein when the top and bottom walls are taut, the sum of the length and width of the top wall is at least 5 inches greater than the sum of the length and width of the bottom wall.

3. The mattress of claim 2 in which the sum of the length and width of the top wall is no more than 20 inches greater than the sum of the length and width of the bottom wall.

4. The mattress of claim 1 in which the mattress capacity is at least 14 inches of water.

5. The mattress of claim 1 in which all of the folds are in a regular repeating pattern.

6. The mattress of claim 1 in which L is at least about 3 inches.

7. The mattress of claim 1 in which the top wall has a length and a width, the length being greater than the width, and wherein the folds are formed into the mattress so that the width increases by a greater percentage than the length increases when a user lays on the mattress aligned with the length of the top wall.

8. The mattress of claim 1 including a frame around the periphery of the mattress, the height of the frame being at least 3 inches less than the mattress capacity.

9. The mattress of claim 1 including a stretchable cover on the top wall of the mattress.

10. The mattress of claim 9 in which the cover stretches in an amount about the same as the top wall of the mattress stretches.

11. The mattress of claim 1 in which the folds are molded into the top wall.

12. The mattress of claim 1 including a frame around the periphery of the mattress and a cover extending over the mattress and the frame, the cover stretching in an amount about the same as the top wall of the mattress stretches.

13. The mattress of claim 1 in which the folds are curvilinear.

14. The mattress of claim 1 in which the top wall is made of high molecular weight vinyl.

15. The mattress of claim 1 in which the top wall is made of thicker polymeric material than is the bottom wall.

16. The mattress of claim 1 including expandable folds in the side walls.

17. A waterbed mattress having a polymeric top wall providing a sleeping surface, a bottom wall, and side walls, the top wall having a length and a width, the length being greater than the width, the ratio of the surface area of the top wall when pulled taut to the surface area of the bottom wall when pulled taut being at least 1.05 and less than 1.2, the top wall having a plurality of curvilinear expandable folds formed therein so that the top wall stretches when a user lays on the mattress, at least a portion of the folds being in a regular repeating pattern spaced apart from each other by a distance, L, of from about $\frac{1}{4}$ to about 3 inches, the ratio of the height of the regularly repeating folds to L being from about $\frac{1}{8}$ to about $\frac{1}{2}$, the mattress capacity being at least 11 inches of water, and the mattress containing (i) water in an amount of at least 3 inches less than its capacity and (ii) a baffle for reducing wave motion in the mattress and for preventing bottoming of the top wall of the mattress when a user sits or lays on the mattress, wherein the folds are formed into the mattress so that the width of the top wall increases by a greater percentage than the length of the top wall increases when a user lays on the mattress aligned with the length of the top wall.

18. A waterbed mattress having a polymeric top wall providing a sleeping surface, a bottom wall, and side walls, the ratio of the surface area of the top wall when pulled taut to the surface area of the bottom wall when pulled taut being at least 1.05 and less than 1.2, the top wall having a plurality of expandable folds formed therein so that the top wall stretches when a user lays on the mattress, at least a portion of the folds being circular, at least a portion of the folds being in a regular repeating pattern spaced apart from each other by a distance, L, of from about $\frac{1}{4}$ to about 3 inches, the ratio of the height of the regularly repeating folds to L being from about $\frac{1}{8}$ to about $\frac{1}{2}$, the mattress capacity being at least 11 inches of water, and the mattress containing (i) water in an amount of at least 3 inches less than its capacity and (ii) a baffle for reducing wave motion in the mattress and for preventing bottoming of the top wall of the mattress when a user sits or lays on the mattress.

* * * * *